US007610925B2

(12) United States Patent
Parisi

(10) Patent No.: US 7,610,925 B2
(45) Date of Patent: Nov. 3, 2009

(54) AUTOMATICALLY OPENING ECCENTRIC UMBRELLA

(76) Inventor: Diego Parisi, 7 Adamello Street, Lovere (IT) 24065

( * ) Notice: Subject to any disclaimer, the term of this patent is extended or adjusted under 35 U.S.C. 154(b) by 0 days.

(21) Appl. No.: 12/071,077

(22) Filed: Feb. 15, 2008

(65) Prior Publication Data

US 2008/0135075 A1 Jun. 12, 2008

Related U.S. Application Data

(63) Continuation-in-part of application No. 11/017,039, filed on Dec. 21, 2004, now abandoned.

(30) Foreign Application Priority Data

Aug. 5, 2004 (IT) ..... MI2004U0380

(51) Int. Cl.
*A45B 11/00* (2006.01)

(52) U.S. Cl. ..... 135/20.1; 135/31

(58) Field of Classification Search ..... 135/20.1, 135/22, 32

See application file for complete search history.

(56) References Cited

U.S. PATENT DOCUMENTS

| | | | | |
|---|---|---|---|---|
| 229,685 | A | 7/1880 | Ege | |
| 229,752 | A | 7/1880 | Ray | |
| 553,735 | A | 1/1896 | Murgatroyd | |
| 690,342 | A | 12/1901 | Anderson | |
| 965,652 | A * | 7/1910 | Perell | 135/22 |
| 1,067,435 | A * | 7/1913 | McNamara | 135/26 |
| 2,185,466 | A * | 1/1940 | Jostes | 135/22 |
| 2,707,476 | A | 5/1955 | Clemens | |
| 2,877,782 | A * | 3/1959 | Zimmermann | 135/23 |
| 2,906,277 | A * | 9/1959 | Militano | 135/22 |
| 2,948,289 | A | 8/1960 | Owczarek | |

(Continued)

FOREIGN PATENT DOCUMENTS

| | | |
|---|---|---|
| CA | 2141482 | 8/1996 |

(Continued)

*Primary Examiner*—David Dunn
*Assistant Examiner*—Noah Chandler Hawk
(74) *Attorney, Agent, or Firm*—Bacon & Thomas, PLLC

(57) ABSTRACT

An automatic opening umbrella having a canopy, and a support shaft and an opening mechanism offset or eccentric from the center of the canopy, is described. The opening mechanism includes a framework including varying length rib, link and brace sets on each side of a longitudinal axis of symmetry of the umbrella, the sets being mirror images, with equal numbers of ribs, links and braces. The longest links at distal ends are pivotally connected to a respective longest rib and the longest braces are pivotally connected at distal ends to respective longest links at a mutual connection with the longest link connections to the longest ribs. The shorter links are pivotally connected at distal ends to shorter ribs along the rib lengths. The shorter braces are pivotally connected at distal ends to respective links along the lengths of the links. The ribs at proximal ends are all connected to an upper ring fixed to the shaft and the proximal ends of the links and braces are respectively pivotally connected to intermediate and lower rings that are slidably mounted on the shaft and which are spring biased to separate from each other along the shaft for automatic opening of the umbrella. A geometric relation between lengths of links and braces is described.

3 Claims, 5 Drawing Sheets

U.S. PATENT DOCUMENTS

| | | | | | |
|---|---|---|---|---|---|
| 3,042,055 | A | | 7/1962 | Todorovic | |
| 3,304,035 | A | | 2/1967 | Davis | |
| 3,837,352 | A | * | 9/1974 | Weber | 135/25.3 |
| 4,086,931 | A | | 5/1978 | Hall | |
| 4,474,200 | A | | 10/1984 | Kida | |
| 4,474,201 | A | * | 10/1984 | Kida | 135/26 |
| 5,063,952 | A | * | 11/1991 | Seidel et al. | 135/22 |
| 5,505,221 | A | | 4/1996 | Gao | |
| 5,642,747 | A | | 7/1997 | Rizzotti | |
| 6,814,093 | B2 | | 11/2004 | You | |

FOREIGN PATENT DOCUMENTS

| | | |
|---|---|---|
| WO | WO 99/44458 | 9/1999 |

* cited by examiner

FIG. 1
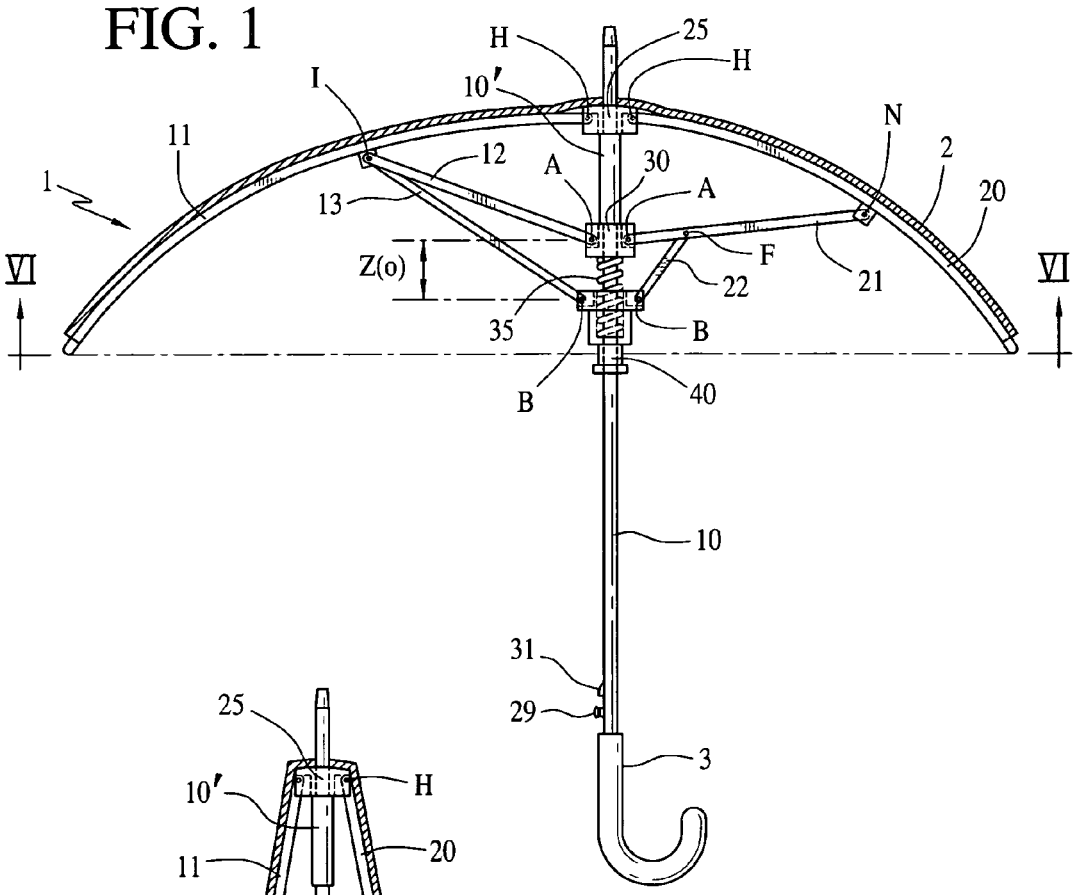
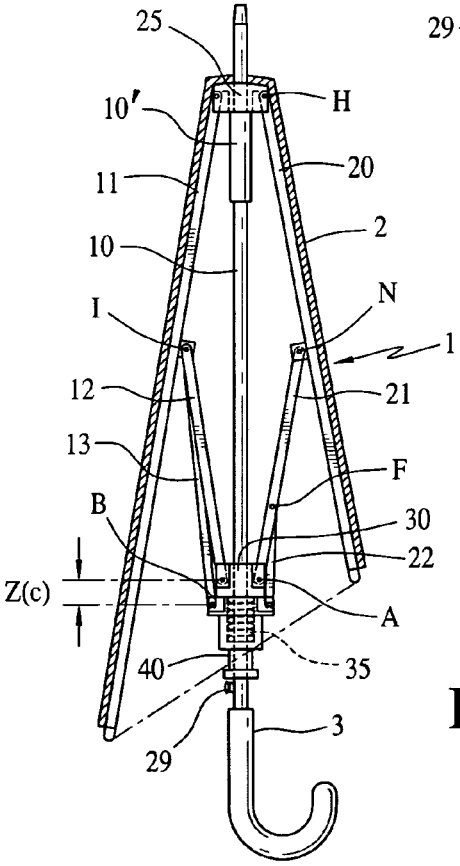
FIG. 2

FIG. 4
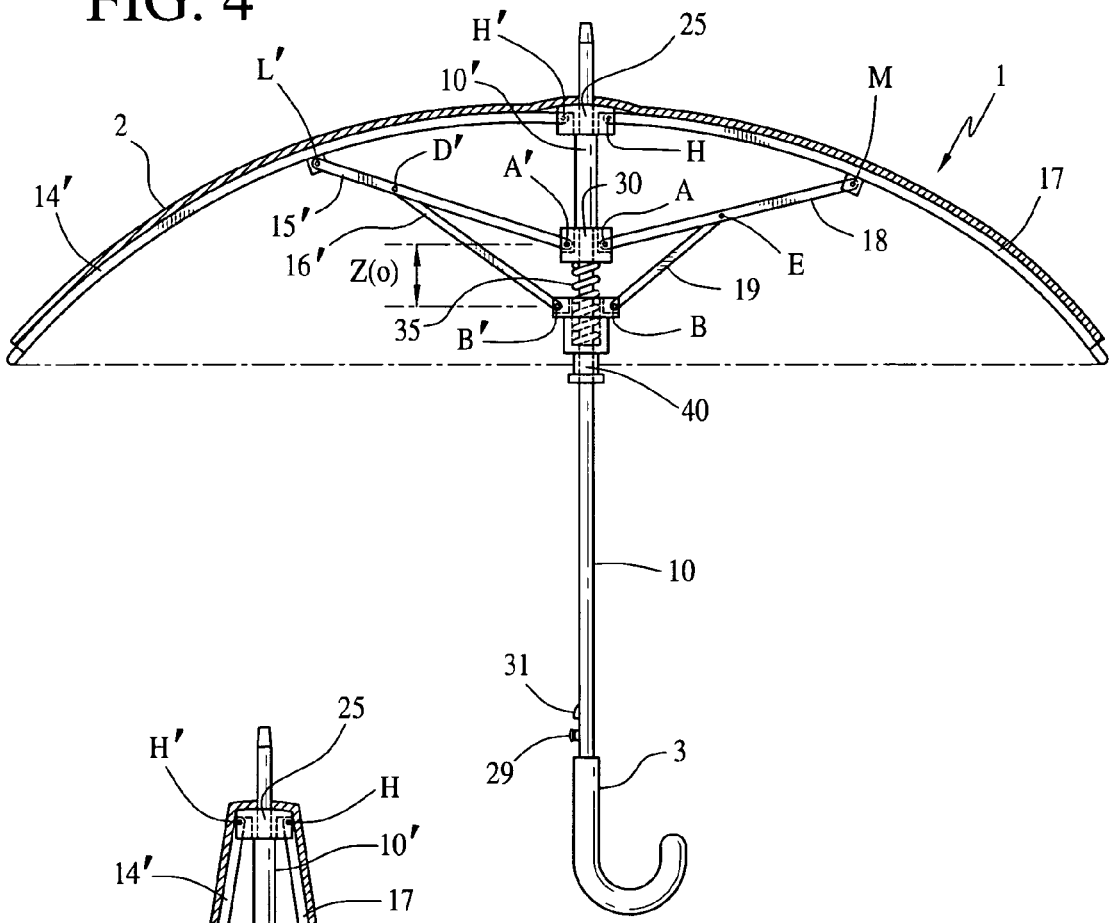
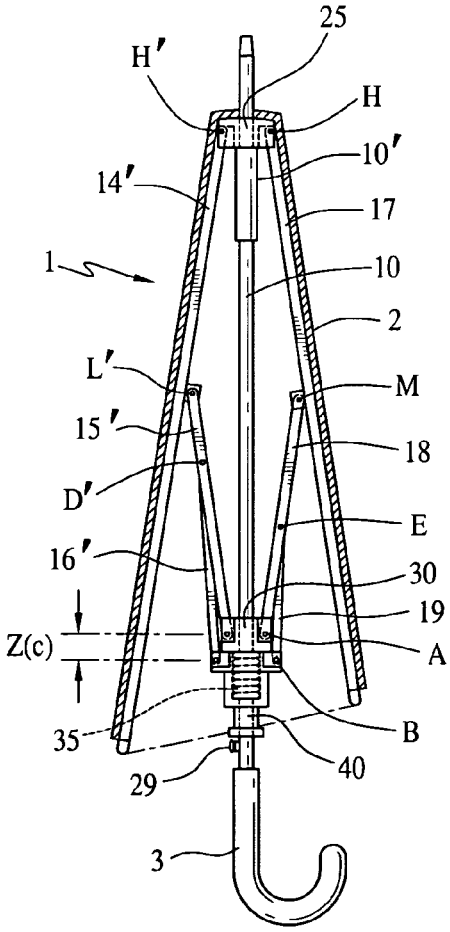
FIG. 5

AUTOMATICALLY OPENING ECCENTRIC UMBRELLA

CROSS-REFERENCE TO RELATED APPLICATIONS

This application is a continuation-in-part of application Ser. No. 11/017,039 filed Dec. 21, 2004, the entirety of which is incorporated herein by reference.

FIELD OF INVENTION

This invention relates to an automatically opening, foldable offset or eccentric umbrella, namely an umbrella having a central support shaft that is offset or eccentric relative to the center of its canopy or the support framework for the canopy.

BACKGROUND OF THE INVENTION

An exemplary eccentric foldable umbrella having a carrying shaft that is offset from the center of its canopy is described in U.S. Pat. No. 2,948,289 to Owczarek, wherein a manually opening foldable umbrella is described as having a canopy and a framework connected to the canopy and shaft, the framework including a plurality of ribs and links on each side of the axis of symmetry of the umbrella which are of different lengths.

SUMMARY OF THE INVENTION

This invention relates to an umbrella having a support and carrying shaft that is offset or eccentric from the center of its canopy utilizing an opening and closing framework connected to the shaft and supporting the canopy relative to the shaft. The framework includes a plurality of ribs, links and braces of varying lengths, along with rings on the shaft connecting the inner ends of the ribs, links and braces to the shaft. The umbrella is intended preferably for use with an automatic opening device that actuates two of the rings of the framework for opening and closing (unfolding and folding) the canopy. Rib, link and brace sets are utilized in the framework on each side of the longitudinal axis of symmetry or the umbrella that, on a common or same side of the axis of symmetry, are of varying lengths, with the rib, link and brace lengths on the opposite side of the axis of symmetry being in mirror image relative to the first set of rib, link and brace lengths. The braces of each brace set are of different lengths because the corresponding links of the umbrella have different inclinations with respect to the axis of the shaft when the umbrella is open. Consequently, to provide an automatic opening umbrella in a manner that functions more efficiently and thus is smaller than a conventional manually opening eccentric umbrella, a precise relationship among the different parts that form the framework of the umbrella is highly desirable, in particular with regard to the parts constituting the links and the braces. Thus, with the umbrella open, the most inclined links of the link sets will be operatively associated with the longest of the braces of the brace sets (the longest braces being called "second" type of braces herein) and the least inclined links of the brace sets will be operatively associated with the braces of the brace sets that are shorter than the longest braces (the shorter braces also being called "first" type of braces herein).

To make such eccentric umbrella fully open and close like a conventional automatic umbrella, in accordance with this invention a particular relation must occur between the second type of braces and their corresponding second type of links and between the first type of braces and their corresponding first type of links so that the difference between a length of a second type of brace and a length of a corresponding second type of link is equal to the difference between a length of any first type of brace and a length of its corresponding first type of link.

BRIEF DESCRIPTION OF THE DRAWINGS

FIG. 1(*a*) is a perspective exploded detail view of the distal end of a second (longest) type of brace and the distal end of the corresponding second type of link connected thereto, illustrating an exemplary manner in which such brace and link are connected to a corresponding longest rib of the umbrella;

FIG. 1(*b*) is a perspective exploded detail view of the distal end of a first (shorter) type of brace and the distal end of a corresponding first type of link connected thereto, illustrating how each shorter type of brace may be fixed in relation to a corresponding shorter rib of the umbrella;

FIG. 1(*c*) is perspective detail view of an exemplary actuating button and lock of the umbrella located on the umbrella shaft, and an umbrella handle member;

FIG. 2 is an elevational, partial sectional view of the umbrella taken along the axis of symmetry I-I of FIG. 3 with the umbrella in folded or closed condition;

FIG. 4 is an elevational, partial sectional view of the umbrella, the section being taken along line IV-IV of FIG. 3;

FIG. 5 is an elevational, partial sectional view of the umbrella, the section being taken along the line IV-IV of FIG. 3 with the umbrella in the folded or closed position.

DETAILED DESCRIPTION OF THE PREFERRED EMBODIMENT(S) OF THE INVENTION

Figure 1A:
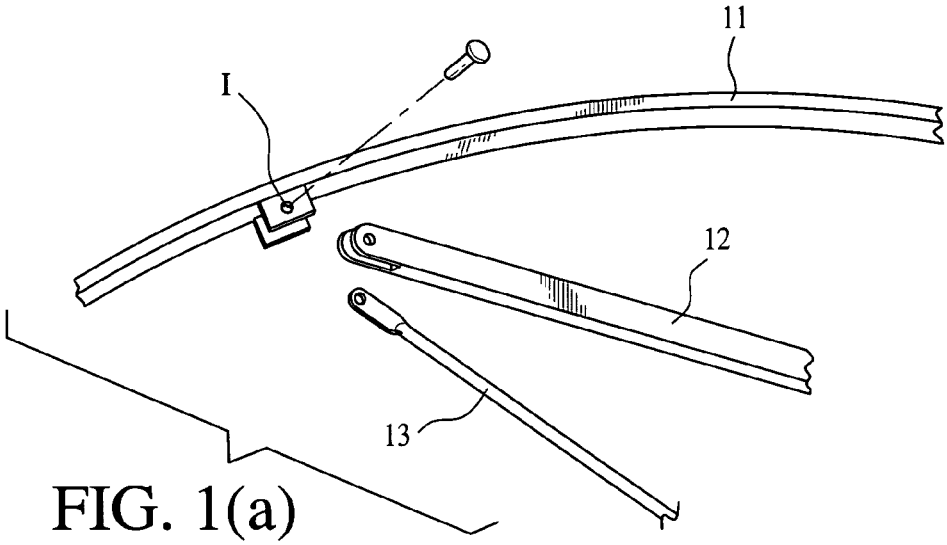
FIG. 1 is an elevational, partial sectional view of a preferred embodiment of an automatically opening eccentric umbrella embodying the invention, the section being taken along the unfolded or open umbrella axis of symmetry I-I of FIG. 3.

With reference to the appended drawings, a foldable, automatically opening, eccentric umbrella 1 including a canopy 2 preferably having a polygonal shape, a carrying or support shaft 10, and a support framework that will be described below, is shown as embodying a preferred embodiment of the invention.

The shaft 10 and support framework of the umbrella are arranged offset from or eccentric relative to a geometric center of the canopy 2 of the umbrella 1. The support framework includes an upper ring 25 fixed to a top end area of the shaft 10, and an intermediate ring 30 located below the upper ring and which is supported on the shaft 10 for sliding movement along the shaft. A lower ring 40 is also slidably mounted on the shaft for sliding movement along the shaft between the intermediate ring 30 and handle 3 of the shaft. A compression spring 35 (e.g. a coil spring) is positioned between the intermediate ring 30 and the lower ring 40 in a manner such that, in accordance with this embodiment of the invention, elongation of the spring from a more compressed condition to an expanded condition urges or biases the intermediate ring upwardly in a direction away from the lower ring along the shaft 10.

Figure 1B:
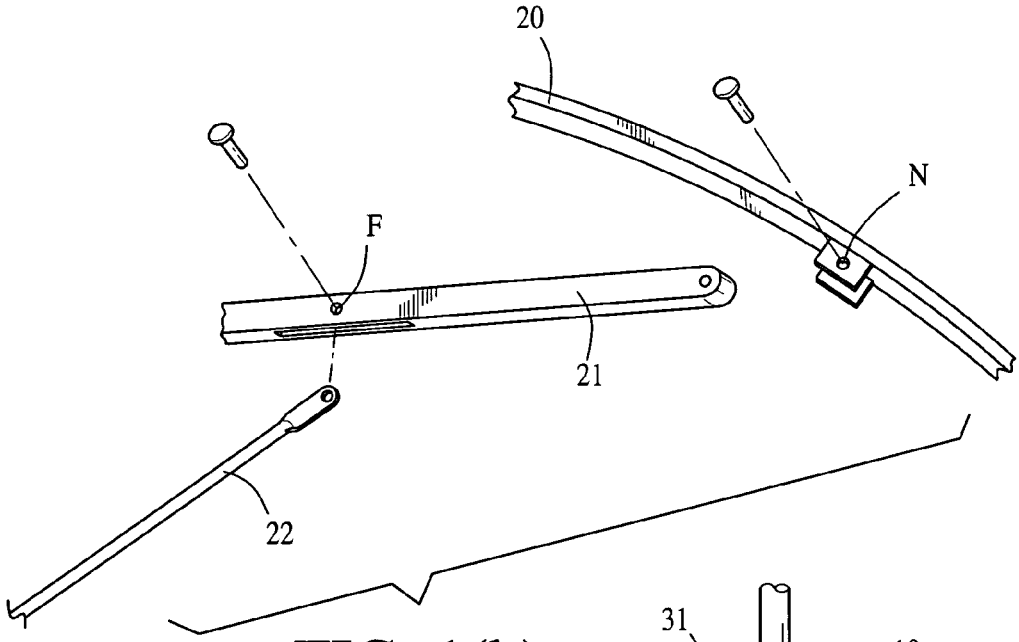
Figure 1C:
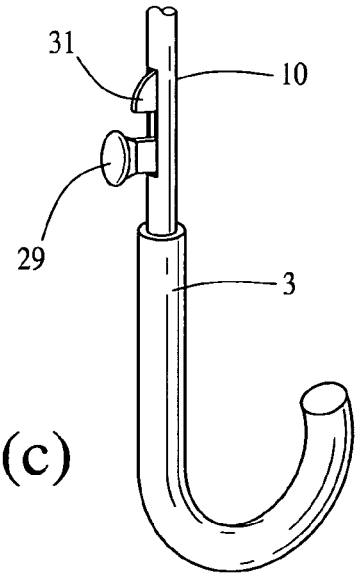

In folded condition of the umbrella as seen in FIG. 2, both intermediate and lower rings are located near the handle 3 of the umbrella, whereas in the unfolded or open position of the umbrella as seen in FIG. 1, the intermediate and lower rings are positioned further up on the shaft 10 between the handle 3 and the upper ring 25. A stop element 10' limits upward movement of the intermediate ring 30 along shaft 10. In a known manner, the lower ring is normally locked to the shaft 10 by a lock 31 on the shaft as will be described in more detail below with regard to FIG. 1(*c*), but may be released by pressing button 29 to enable the spring 35 to push the intermediate ring 30 away from the lower ring 40 which actuates the framework to cause the umbrella to automatically open and remain open until manually folded due to the action of the spring in cooperation with the framework elements.

Figure 3:
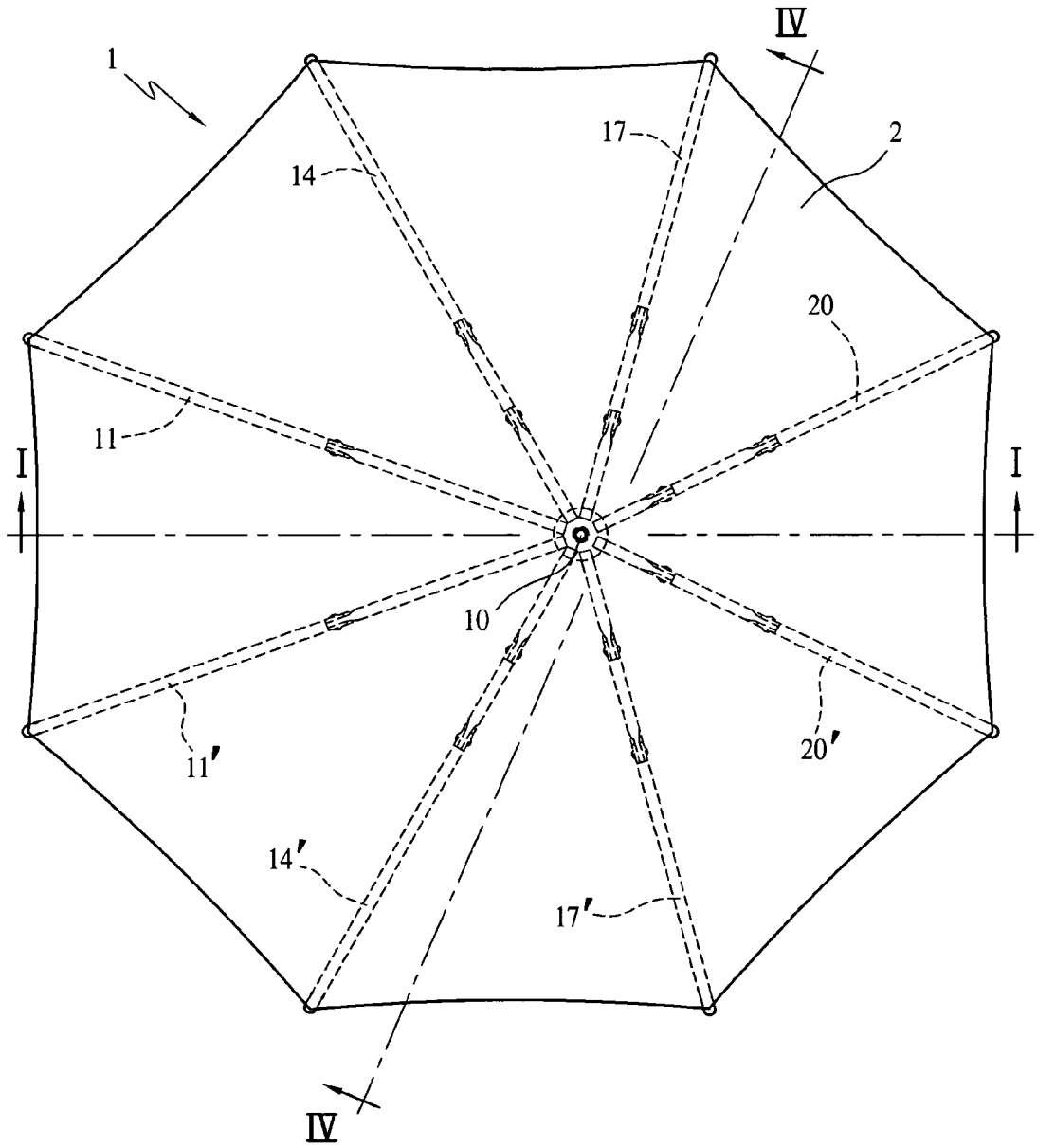
FIG. 3 is a plan view of the umbrella in the unfolded or open position.

Intermediate ring 30 lies closer to the lower ring 40 in the closed position as compared with the open position of the umbrella, as seen by comparing FIGS. 2 and 3.

Figure 6:
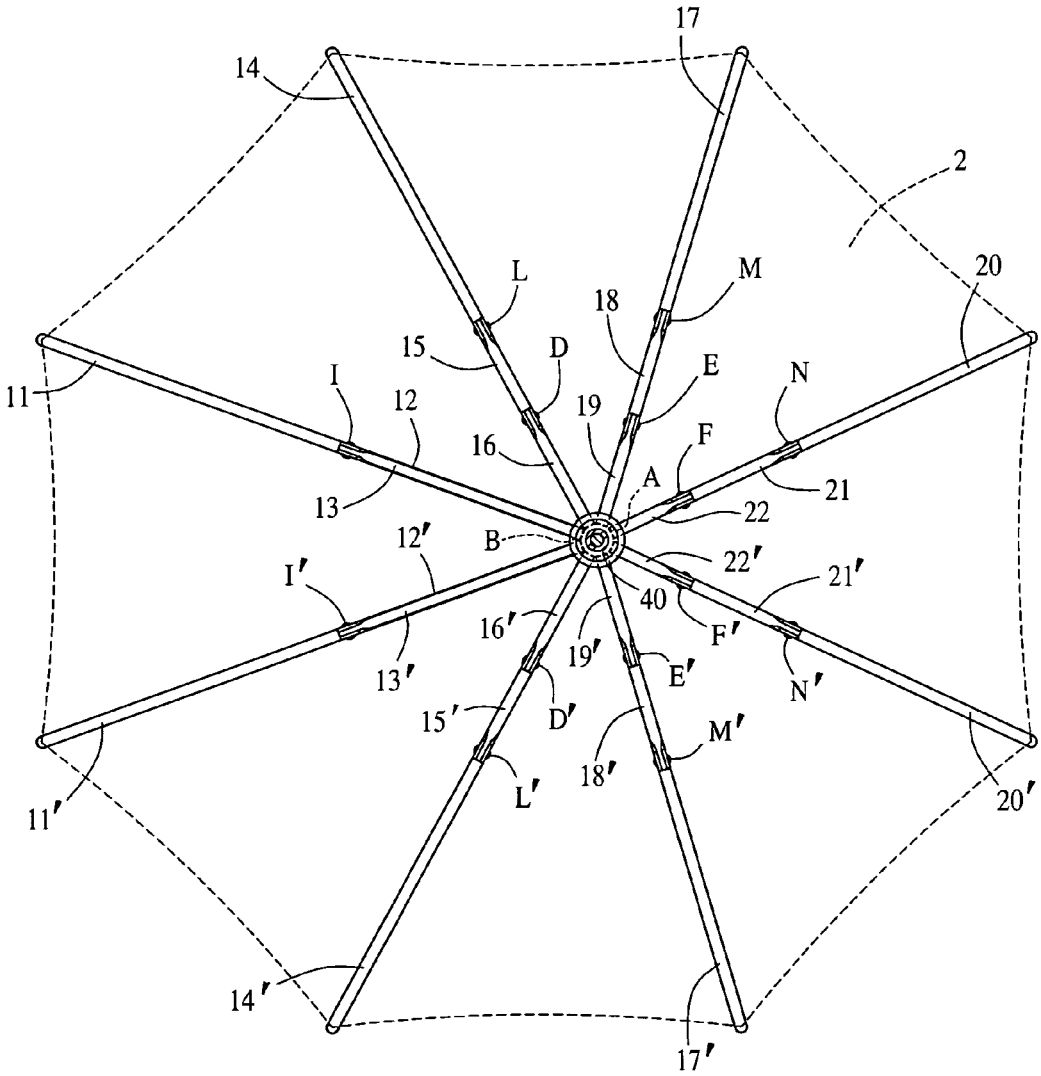
FIG. 6 is a view taken along line VI-VI of FIG. 1.

As seen in FIG. 3, the framework also includes a set of radially extending ribs 11, 14, 17, and 20 located on one side of the axis of symmetry I-I of the umbrella 1 as seen in FIG. 6. An identical counterpart rib set 11', 14', 17' and 20' is disposed in mirror image on the opposite side of the axis of symmetry I-I of the umbrella 1. The ribs, in conventional fashion, are piviotally connected to the upper ring 25 at their proximal ends H, H' and are flexible in a manner enabling support of the canopy 2 in an open, stretched condition by the ribs, which are connected in a fixed manner at least at their distal ends to circumferentially separated attachment points located along or near the periphery of the canopy 2 in any conventional manner. The rib set 11, 14, 17 and 20 and their counterpart ribs 11', 14', 17' and 20' are of different lengths as seen in FIG. 3, with ribs 11, 11' being the longest and ribs 14, 17 and 20, with their counterparts 14', 17' an 20' being progressively shorter relative to ribs 11, 11'. Specifically, the rib set on one side of the axis of symmetry is arranged in length order as follows: 11>14>17>20. The same relationship exist in mirror image with regard to the respective counterpart rib set on the opposite side of the axis of symmetry I-I.

For convenience and expediency, the description herein may refer to or describe one set of ribs 11, 14, 17 and 20 on one side of the axis of symmetry I-I of the umbrella but it should be understood that, unless otherwise indicated, the description is intended to apply as well to the respective counterpart rib set that is disposed on the opposite side of the axis of symmetry I-I in mirror image.

The support framework also includes a link set 12, 15, 18 and 21 having different lengths and which is disposed on a common side of the axis of symmetry I-I. A counterpart set of links 12', 15', 18' and 21' having lengths corresponding in mirror fashion respectively with the lengths of links 12, 15, 18 and 21 is provided on the opposite side of the axis of symmetry I-I. The links 12, 15, 18 and 21 all extend between respective ribs 11, 14, 17 and 20 and the intermediate ring 30 to which they are pivotally connected at A, as illustrated in FIGS. 1, 2, 4 and 5. Likewise with regard to the counterpart links, which are pivotally connected to the intermediate ring 30 at A'. The links 12, 15, 18 and 21 are arranged in length order as follows: 12>15>18>21 and are each pivotally connected at a distal end to a respective rib 11, 14, 17 and 20 along its length at I, L, M, and N, respectively. The links 12, 15, 18 and 21, as mentioned above, are each pivotally connected at a proximal end to the intermediate ring 30 at A in circumferentially spaced order. The lengths of the counterpart links 12', 15', 18' and 21' are also arranged in mirror image on the opposite side of the axis of symmetry I-I, in the same length order, and are connected to the ribs 11', 14', 17' and 20' in like manner with regard to longest and shorter links and to intermediate ring 30 at A'.

For convenience and expediency, the description herein may refer or describe only the one set of links 12, 15, 18 and 21 on one side of the axis of symmetry I-I of the umbrella and it will be understood that, unless otherwise indicated, the description is intended to apply equally with respect to counterpart set of links that is disposed on the opposite side of the axis of symmetry I-I in mirror image.

The support framework also includes a set of different length braces 13, 16, 19 and 22 disposed on a common side of the axis of symmetry I-I. Such braces are arranged in length order as follows: 13>16>19>22. Each of the braces 13, 16, 19 and 22 extends between a respective link 12, 15, 18 and 21 and the lower ring 40, with the distal end of brace 13 pivotally connected to rib 11 mutually with longest link 12 at I, along the length of the rib 11, as shown in FIG. 1(*a*). Each shorter brace 16, 19 and 22 is pivotally connected at a distal end to a shorter link 15, 16 and 21 along its length at D, E and F, respectively. The proximal end of each brace 13, 16, 19 and 22 is pivotally connected to the lower ring 40 at B in peripherally spaced order.

Likewise, different length counterpart braces 13', 16', 19' and 22' are arranged in mirror image order on the opposite side of the axis of symmetry I-I and extend between respective links 12', 15', 18' and 21', and the lower ring 40, with the counterpart longest brace 13' being pivotally connected to the longest rib 11' along the length of the rib (see FIG. 1(*a*)) at a distal end thereof mutually with the distal end of the longest link 12'. Counterpart shorter braces 16', 19' and 22' are pivotally connected at their distal ends to the shorter counterpart links along their lengths at D', E', and F'. The counterpart braces are pivotally connected at their proximal ends to the lower ring 40 in peripherally spaced relationship at B'.

For convenience and expediency, the description herein may refer to or describe only the one set of braces 13, 16, 19 and 22 located on one side of the axis of symmetry I-I of the umbrella and it should be understood that, unless otherwise indicated, the description is intended to apply as well to the respective counterpart of each of the one set of braces that is disposed on the opposite side of the axis of symmetry I-I in mirror image.

As mentioned previously, the plurality of braces of different lengths may be regarded as two different types: the first type comprises shorter braces 16, 19 and 22 and the second type comprises the longest brace 13. Likewise with regard to the counterpart braces, the term "shorter" is used herein to indicate a shorter length rib, link or brace relative to the longest rib, link or brace of the framework on each side of the longitudinal axis of symmetry I-I of the umbrella.

The distal ends of shorter links 15, 18 and 21 are fixed to a corresponding rib 14, 17 and 20 at pivot connections L, M, and N, with each pivot connection L, M and N in the preferred embodiment comprising two pierced spaced plates internally of which each distal end of links 15, 18 and 21 is positioned and secured by an appropriate fastener enabling relative pivotal movement between the connected elements, such as a rivet, for example, as shown in FIG. 1(*b*), while the distal end of longest link 12 is fixed to a corresponding rib 11 by a pivot connection I comprising two pierced spaced plates externally of which each distal end of link 12 is positioned, as shown in FIG. 1(*a*). The link 12 and brace 13, as seen in FIG. 1(*a*) are mutually pivotally connected to rib 11 at I by a common fastener enabling pivotal movement between the connected elements, for example a rivet or the like, with the distal end of brace 13, for example, located internally of the pierced spaced plates. It should be understood that the illustrated and described connections between ribs and links and braces is exemplary and any appropriate connections enabling pivotal movement between the elements could be utilized without departing from the spirit and scope of the invention. The ribs 11, links 12 and braces 13 are illustrated as having a closed form, they could as well be constructed as open channels or other configurations suitable for use in umbrella frameworks. Different types of fasteners suitable for pivot connections may be utilized in accordance with techniques and fastening technology known to those skilled in the art. The primary requirement of the construction of ribs, links and braces as well as their connections is that they be structurally suitable for use in an umbrella framework while permitting opening and closing movements of the framework.

Each shorter (first type of) link of rib set 15, 18 and 21 has a link portion extending between the pivot connection A on the intermediate ring member 30 and the pivot connection D, E, and F fixing each link 15, 18 and 21 to a corresponding shorter brace 16, 19 and 22 of the first type. The link portions AD, AE and AF on the same side of the axis of symmetry I-I are of different lengths. Such link portions are arranged in length order as follows: AD>AE>AF as shown in FIG. 1, 4 and 6. The same relationship exists with regard to the counterpart link and brace set on the opposite side of the axis of symmetry.

It is to be noted that the length of each brace is determined by the inclination angle of each respective link relative to the axis of shaft 10 when the umbrella is in the open position. In the preferred embodiment, the shaft 10 is positioned at approximately ⅗ of the diameter of a polygon forming the umbrella canopy 2, as shown in FIG. 3. Consequently, it turns out that the second type of brace 13 must be longer than the first type of brace because the corresponding link 12 is of all the links the most inclined; on the other hand, each of the first type of brace 16, 19 and 22 will be progressively shorter than brace 13 because the corresponding shorter links 15, 18 and 21 are less inclined than link 12 and each brace of each brace set will be inclined at a different angle from the other braces of the respective set. The distal end of brace 13 represents the most distant end that a brace of the framework can have to enable the construction of the automatic umbrella, as shown in FIG. 1 and 4. The same relationship exists with regard to the counterpart braces.

To enable such umbrella to fully open and close like a conventional automatic umbrella, two conditions must take place at the same time as expressed by the following two relations.

The first relation is: IH+IA=LH+LA=MH+MA=NH+NA.

In accordance with this relation, the sum of the length of rib portion IH plus the length of the corresponding link IA is equal to the length of any other rib portion LH, NH and NH plus the corresponding link LA, MA and NA, as shown in FIGS. 1, 4 and 6.

The second relation is: BI−AI=BD−AD=BE−AE=BF−AF=Z(c).

That is, the difference between the length of the second type of brace BI and the length of the corresponding link AI is equal to the difference between a length of any other first type of brace BD, BE and BF and a length of a corresponding link portion AD, AE and AF. Such difference is equal to the distance Z(c) between the pivot connections A, A' on intermediate ring 30 and the pivot connections B, B' on lower ring 40 when such rings are in a closed umbrella positions, as shown in FIG. 1, 2, 4 and 5. The distance between rings 30 and 40 will increase to Z(o) as shown in FIG. 1 when the spring 35 pushes the intermediate ring upwardly away from lower ring 40 when the lower ring is released by releasing lock 31 via push button 29 on shaft 10 (see FIG. 1(*c*)) The force of the spring on the framework braces, links and ribs will effect automatic opening of the umbrella in a conventional manner. The closure of the umbrella 1 is effected by manual folding movement in a conventional manner and is completed when the lower ring 40 engages lock 31.

While a preferred embodiment of a complete umbrella has been described, it should be noted that the invention may encompass the shaft and framework elements without a canopy attached.

It will be understood that the description of the invention herein provided is exemplary only of a preferred embodiment, and that other appropriate and operative embodiments could be constructed to achieve substantially the same result in substantially the same way as described herein without departing from the scope of the invention, which is to be regarded as being limited only by the scope and meaning of the appended claims.

What is claimed is:

1. A support arrangement for an automatically opening eccentric umbrella comprising:

a support shaft;

an upper ring fixed at an upper end of the support shaft;

an intermediate ring slidably supported on the support shaft below the upper ring;

a lower ring slidably support on the support shaft below the intermediate ring;

a spring positioned between said intermediate and lower rings, said spring arranged to normally bias the intermediate ring away from the lower ring towards the upper ring, but enabling the intermediate and lower rings to approach each other against the spring bias;

a support framework having a longitudinal axis of symmetry, comprising:

radially extending rib sets on opposite sides of the axis of symmetry, the sets of ribs including ribs having different lengths from each other in mirror image, with the ribs on each side of the axis of symmetry having different lengths; said ribs at a proximal end being fixed to said upper ring by a pivot connection and being adapted to be connected at a distal end to a canopy;

radially extending link sets on opposite sides of the axis of symmetry, the sets of links including links having different lengths from each other in mirror image, with the links on each side of the axis of symmetry having different lengths; said links pivotally connected at their distal ends to respective ribs and to said intermediate ring at their proximal ends;

radially extending brace sets on opposite sides of the axis of symmetry, the brace sets including braces having different lengths from each other in mirror image, with the braces on each side of the axis of symmetry having different lengths; said braces pivotally connected at their distal ends to respective links and to the said lower ring at their proximal ends;

said ribs being equal in number to the links and the braces;

wherein said plurality of braces of different lengths are of two different types:

the first type comprising a plurality of braces of each brace set wherein each brace of each set at a proximal end is fixed to said lower ring by a pivot connection and at distal end is fixed to a corresponding link of a respective link set by a pivot connection;

the second type comprising a single longest brace of each brace set wherein each said longest brace at a proximal end is fixed to said lower ring by a pivot connection and at distal end is fixed to a respective rib by a pivot connection, the last said pivot connection being located at the same pivot connection at which the distal end of a corresponding link of a second type is fixed to the respective rib;

wherein each link of each link set fixed to one of the first type of braces has a link portion, said link portion being located between said pivot connection of said first type of braces on said intermediate ring member and said pivot connection connecting each link of said plurality of links of said first type to a corresponding brace of the first type;

wherein the difference between a length of a second type of brace and a length of a corresponding link is equal to the difference between a length of any other first type of brace and a length of a corresponding link portion; and wherein each said difference in length is equal to the distance between the pivot connections for the proximal ends of the links on said intermediate ring member and the pivot connections for the proximal ends of the braces on said lower ring member when said rings are in a closed umbrella position.

2. An automatically opening umbrella comprising the support arrangement according to claim 1, and a canopy extending over and attached at least to the distal ends of said ribs.

3. An automatically opening umbrella according to claim 2, including a handle on a lower end of the shaft; a lock on the shaft adapted to engage the lower ring and to retain the lower ring against movement relative to the shaft when the lower ring is located adjacent to the handle; a release mechanism adapted upon actuation to release said lock to thereby release said lower ring relative to the shaft to permit movement of the lower and intermediate rings in response to a biasing force of said spring urging the intermediate ring to become spaced along the shaft away from the lower ring.

* * * * *

UNITED STATES PATENT AND TRADEMARK OFFICE

CERTIFICATE OF CORRECTION

PATENT NO. : 7,610,925 B2
APPLICATION NO. : 12/071077
DATED : November 3, 2009
INVENTOR(S) : Diego Parisi It is certified that error appears in the above-identified patent and that said Letters Patent is hereby corrected as shown below:

Title page, item (*) Notice: should read as follows: Subject to any disclaimer, the term of this patent is extended or adjusted under 35 U.S.C. 154(b) by 0 days.

Col. 4, line 17: "16" should read --18--.

Col. 5, line 49: "NH" (first occurrence) should read --MH--.

Signed and Sealed this

Third Day of August, 2010

David J. Kappos

David J. Kappos
*Director of the United States Patent and Trademark Office*